US007441303B2

(12) United States Patent
Adair et al.

(10) Patent No.: US 7,441,303 B2
(45) Date of Patent: Oct. 28, 2008

(54) PAVEMENT/SURFACE SWEEPER HAVING A SIMPLIFIED HYDRAULIC SYSTEM

(75) Inventors: Jim E Adair, Huntsville, AL (US); Steve Hanvey, Huntsville, AL (US); James A. Garrett, Greensboro, NC (US)

(73) Assignee: Schwarze Industries, Inc., Huntsville, AL (US)

( * ) Notice: Subject to any disclaimer, the term of this patent is extended or adjusted under 35 U.S.C. 154(b) by 181 days.

(21) Appl. No.: 11/585,997

(22) Filed: Oct. 25, 2006

(65) Prior Publication Data

US 2007/0124892 A1 Jun. 7, 2007

Related U.S. Application Data

(60) Provisional application No. 60/729,733, filed on Oct. 25, 2005.

(51) Int. Cl.
*E01H 1/05* (2006.01)

(52) U.S. Cl. ..... 15/340.3; 15/349; 15/82

(58) Field of Classification Search ..... 15/340.3, 15/340.4, 347–349, 79.2, 82; *E01H 1/05, E01H 1/08*

See application file for complete search history.

(56) References Cited

U.S. PATENT DOCUMENTS 6,959,466 B2 * 11/2005 Alowonle et al. ..... 15/319

* cited by examiner

*Primary Examiner*—David A Redding
(74) *Attorney, Agent, or Firm*—Wallace G. Walter

(57) ABSTRACT

A sweeper unit well-suited for use for sweeping paved areas includes a debris-retaining hopper with an associated fan assembly that includes an air outlet duct for connection to one side of a pick-up head and an inlet duct for connection between the other side of the pickup head and the debris-retaining hopper. A fan drive arrangement includes at least a first and a second hydraulic displacement device to drive the fan and, when required, provide a flow of hydraulic fluid for auxiliary devices including the gutter broom motor(s).

8 Claims, 9 Drawing Sheets

PAVEMENT/SURFACE SWEEPER HAVING A SIMPLIFIED HYDRAULIC SYSTEM

CROSS-REFERENCE TO RELATED APPLICATION

This application claims the benefit of U.S. Provisional Patent Application No. 60/729,733 filed Oct. 25, 2005 by the inventors herein.

BACKGROUND OF THE INVENTION

The present invention relates to mechanized sweepers of the type used for sweeping paved areas, parking areas, and roads and, more particularly, to such sweepers of the type using a hydraulic motor to drive the primary fan and one or more additional hydraulic motors to drive various auxiliary devices, such as gutter broom(s), associated with operation of the sweeper.

Various types of mechanized wheeled vehicles are known for use in sweeping paved surfaces. For example, truck-mounted sweepers are known for sweeping highway and roadway surfaces while other types of sweepers are more suited for sweeping paved areas typically used for parking motor vehicles. In general, pavement sweepers can include a standard truck chassis and a sweeper unit that is mounted to the truck chassis. In most cases, the sweeper unit includes a motor-driven fan, a pick-up head, and a debris-separation hopper. The fan creates a recirculating air flow with the air flow passing from the hopper to and through the pick-up head and back into the hopper where dust, particles, and other debris are removed from the air flow by known separation techniques. In early versions of some types of sweepers, the fan wheel was driven by a drive-shaft connected through a power take-off to the truck engine. In many contemporary sweeper designs, the fan wheel is driven by an auxiliary internal combustion motor that is independent of the truck engine, and, in other contemporary sweeper designs, the fan wheel is driven by a hydraulic motor that receives a flow of hydraulic fluid from a hydraulic pump driven by the truck engine.

In those sweeper designs that use a hydraulic motor to drive the fan wheel, an auxiliary pump is often mounted adjacent to the shaft connecting the fan wheel to its drive motor. The auxiliary pump is typically connected to and driven by the fan shaft through a pulley and belt(s) arrangement so that rotation of the fan shaft will also drive the auxiliary pump. The auxiliary pump then provides a flow of fluid for driving the gutter broom motor(s) as required and other hydraulic accessories, including one or more hydraulic cylinders. This system is adequate for its intended purpose, however, the auxiliary belt-driven pump adds mechanical complexity and cost to the construction of the machine.

SUMMARY OF THE INVENTION

A sweeper unit well-suited for use with sweepers of the type that use a hydraulic motor to drive the fan wheel is provided with a multiple-section hydraulic motor assembly, this is, a unit that has more than one displacement section. These displacement sections may be driven in parallel by flow from the engine-driven pump so that their torque output is "summed" to drive the main fan. Valving may be associated with one section of the multiple-section hydraulic motor so that the one section may be used to drive the auxiliary functions including the curb broom functions as required during this mode of operation. The multiple-section hydraulic motor effectively functions as a "flow divider" metering a fixed portion of the oil to the curb broom system. In an alternate variation of the multiple-section motor, one section of the motor functions a "pump" supplying flow exclusively to auxiliary functions including the curb broom(s).

The full scope of applicability of the present invention will become apparent from the detailed description to follow, taken in conjunction with the accompanying drawings, in which like parts are designated by like reference characters.

DESCRIPTION OF A PREFERRED EMBODIMENT

Figure 1:
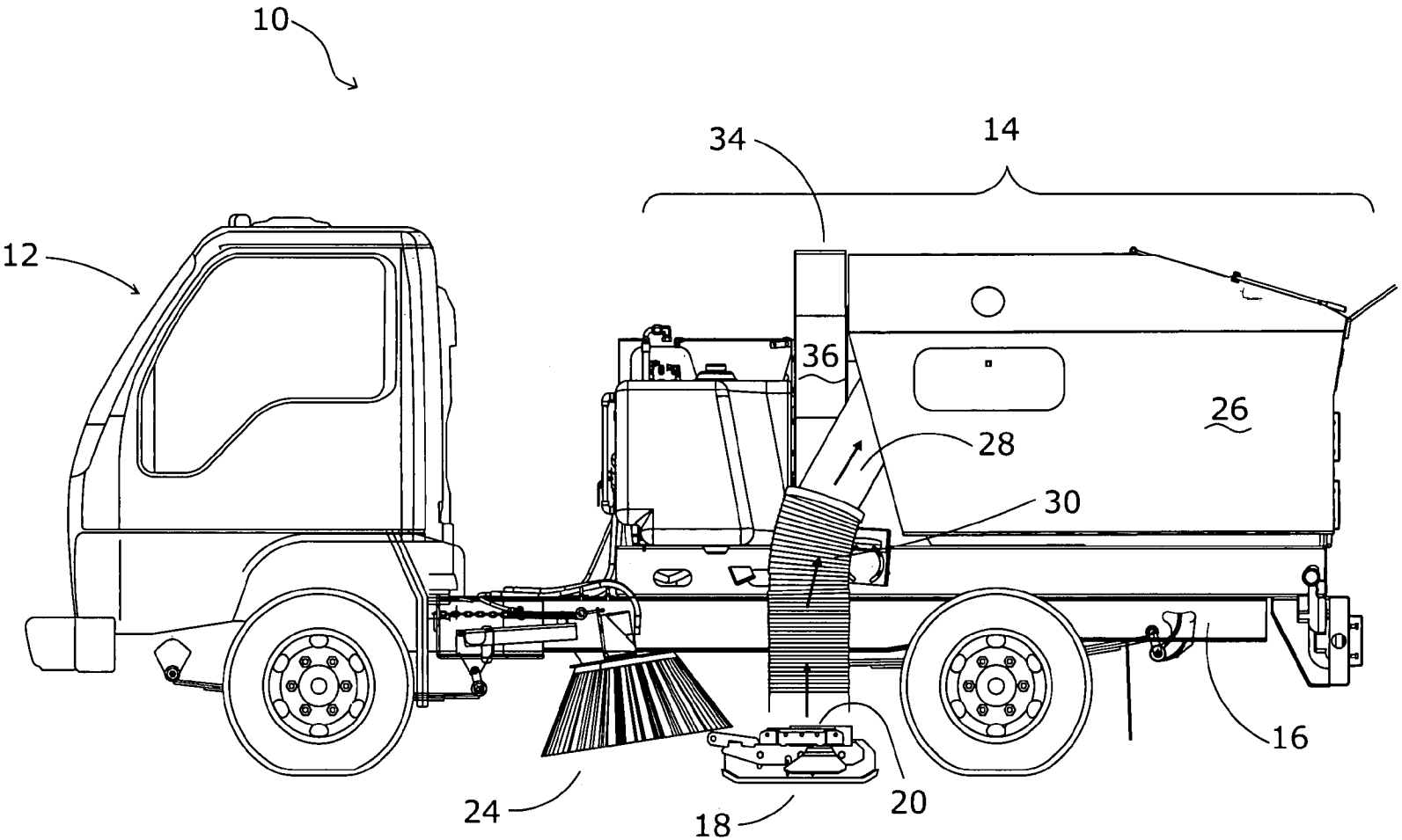
FIG. 1 is a side elevational view of a sweeper vehicle in accordance with the present invention.
Figure 2:
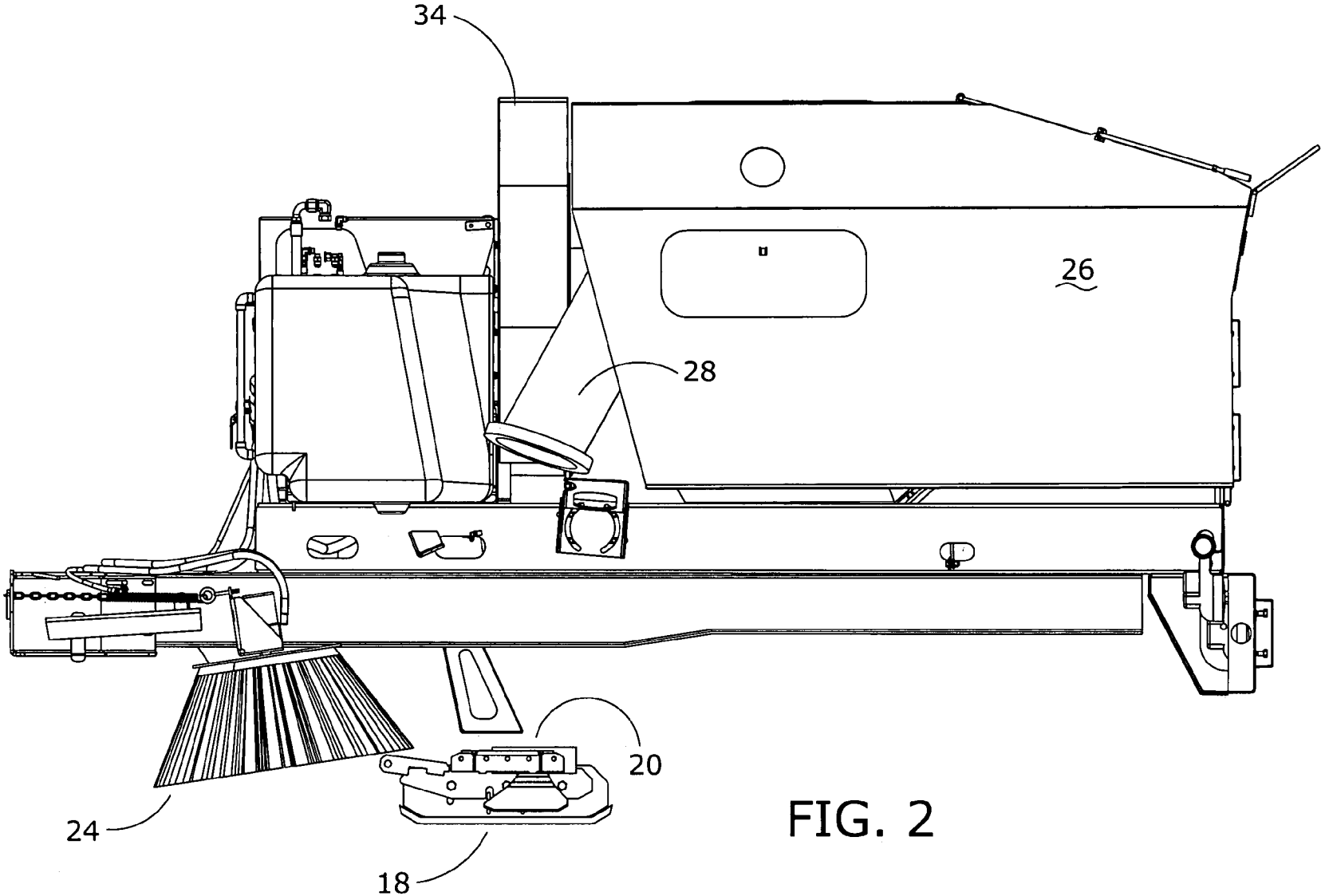
FIG. 2 is a left-side elevational view of the sweeper unit shown in FIG. 1.
Figure 3:
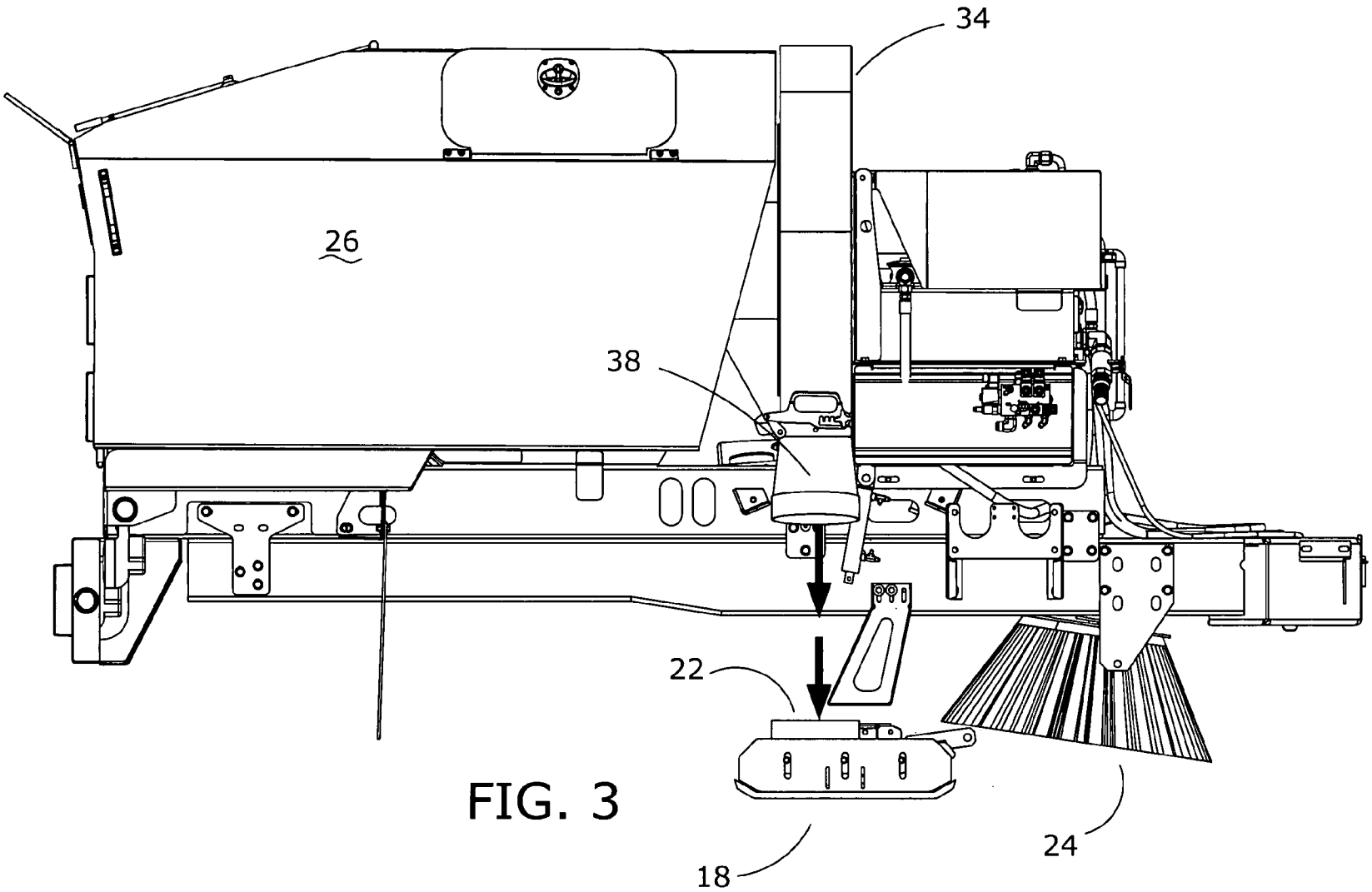
FIG. 3 is a right-side elevational view of the sweeper unit shown in FIG. 1.
Figure 4:
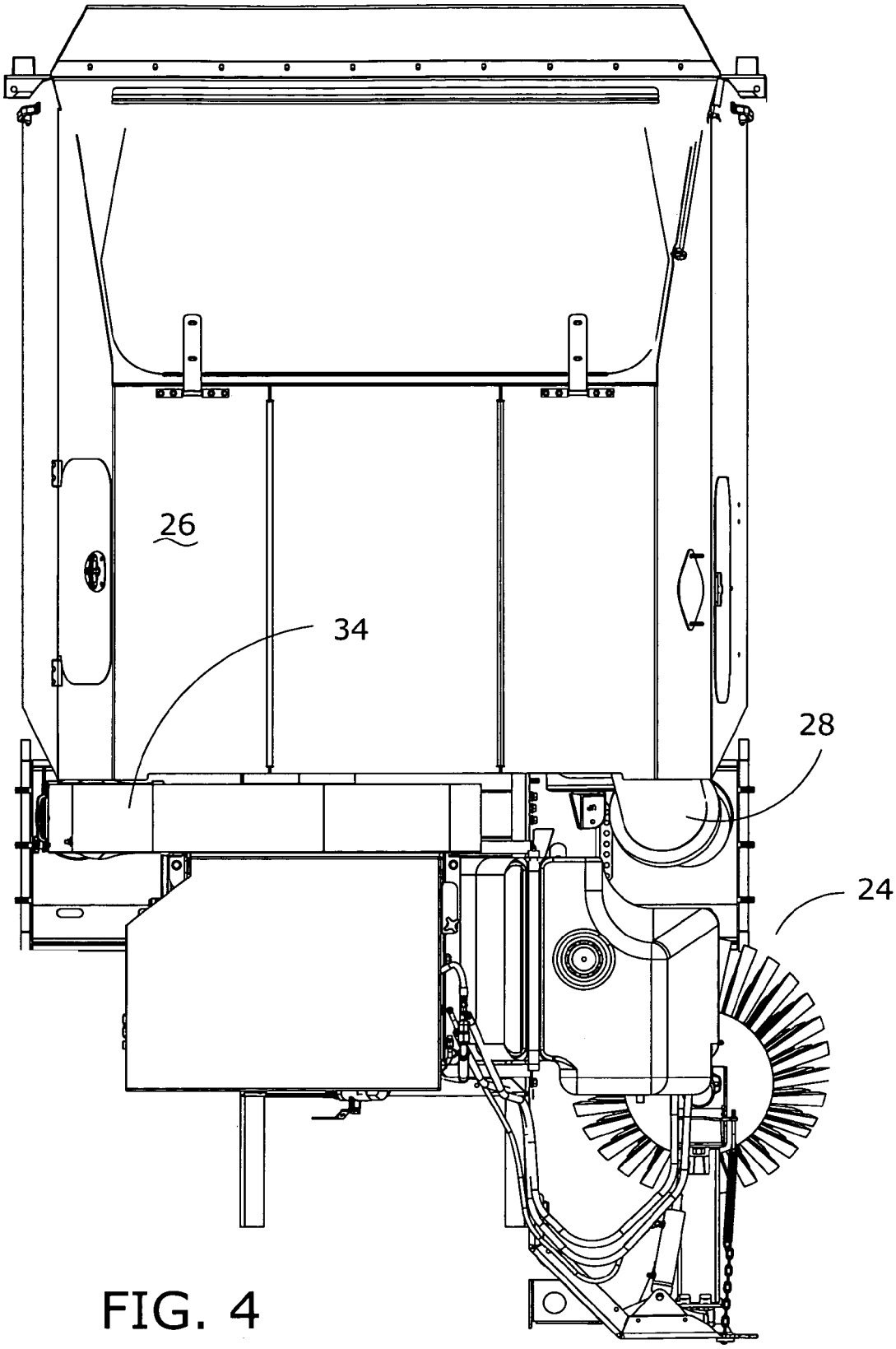
FIG. 4 is a top view of the sweeper unit shown in FIG. 1.
Figure 5:
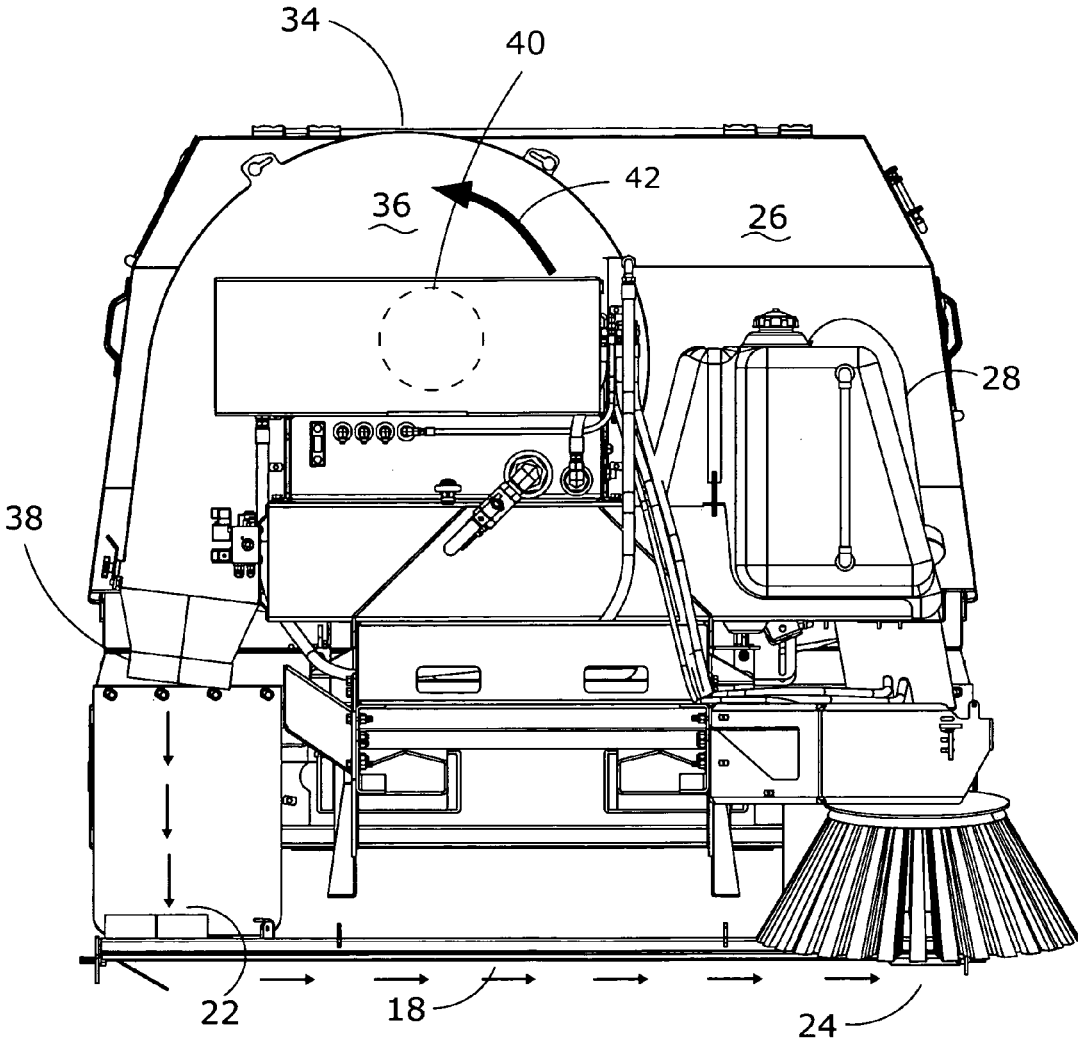
FIG. 5 is a front elevational view of the sweeper unit shown in FIG. 1.

As shown in FIG. 1, a sweeper vehicle incorporating the present invention is designated by the reference character 10 and includes a commercial truck chassis 12 upon which a sweeper unit 14 is mounted. The truck chassis 12 shown is representative of many vehicles from different manufacturers upon which the sweeper unit 14 can be mounted or otherwise adapted; chassis of this type typically include frame members 16 upon which the sweeper unit 14 is mounted or otherwise supported. The sweeper vehicle 10 includes a pick-up head 18 that extends laterally substantially across the side-to-side width of the truck chassis 12 from a driver side (i.e., a "left" side) to the right side of the vehicle. The pick-up head 18 is typically suspended below the chassis by links, bars, or chains (not specifically shown), or a combination thereof, so that the pick-up head 18 can ride on or be supported a small distance above the surface to be sweep as the sweeper vehicle 10 moves forward. As shown in FIG. 1, the pick-up head 18 includes an air-flow outlet 20 and, as shown in FIG. 5, an air-flow inlet 22; the respective purposes of which are discussed below. Additionally, a rotatable gutter broom 24 is shown mounted on the driver side of the vehicle to sweep debris into the path of the pick-up head 18. The sweeper unit 14, which is also shown in FIGS. 2-4, includes a debris-receiving hopper 26 that receives dust, debris, particulates, and other air-entrainable materials sweep from the pavement surface. The hopper 26 includes a suction inlet or debris-uptake inlet 28 located on the left or driver side of the vehicle that is connected to the air-flow outlet 20 of the pick-up head 18 by a suitable flex-hose 30 or the like (shown in both solid and dotted-line illustration). As explained below, a debris-entrained air flow exits the air-flow outlet 20 of the pick-up head 18 and flows through the flex-hose 30 to enter the suction inlet or debris-uptake inlet 28 of the debris-receiving hopper 26.

As shown in FIGS. 1-6, a fan assembly 34 is mounted at the front side of the sweeper unit 14 and is designed to establish a recirculating air flow as described below.

As shown in the top view of FIG. 4, the debris-uptake or suction inlet 28 is located on the driver side (i.e., the vehicle left side) of the hopper 26 in a position behind or aft of the driver position while the fan assembly 34 is mounted toward the passenger side (i.e., the vehicle right side) in a position that can be described as spaced from the driver position. The fan assembly 34 includes a fan housing 36 having a pressurized-flow outlet 38 (FIG. 5) that connects via a flex-hose (not shown) to the air-flow inlet 22 of the pick-up head 18. The fan wheel (not shown) is driven by a hydraulic motor assembly 40 (represented in FIG. 5 in dotted-line) that receives a flow of fluid from a pump (not shown) connected to the truck engine. As shown by the directional arrow 42 in FIG. 5, the fan wheel is rotated by its motor assembly 40 in a direction that provides a pressurized air flow through the outlet 38. The fan assembly 34 may take the general form shown in U.S. patent application Ser. No. 09/528,168 filed Mar. 17, 2000 and incorporated herein by reference. Various hydraulic hoses, pipes, valves, and related structures are not shown in FIG. 5 for reasons of clarity.

As shown by the air-flow arrows in FIGS. 1 and 5, the fan assembly 34 establishes a recirculating air flow from the pressurized-flow outlet 38 of the fan housing 36 through the connected flex-hose (not specifically shown) to the air-flow inlet 22 of the pick-up head 18. From the viewpoint of FIG. 5, the pressurized air flow moves laterally across the underside of the pick-up head 18 from the non-driver side to and toward the driver side and then through the outlet 20 of the pick-up head 18 and through the flex-hose 30 and then into the suction inlet 28 of the debris-receiving hopper 26. As the pressurized air flows in the pick-up head 18 any dust, debris, etc. is entrained in the air flow and carried toward and to the air flow outlet 20 of the pick-up head 18 through the flex-hose 30 to the suction inlet 28 of the hopper 26 as more fully described in U.S. Provisional Patent Application 60/672,870 filed Apr. 20, 2005, the disclosure of which is incorporated herein by reference.

Figure 6:
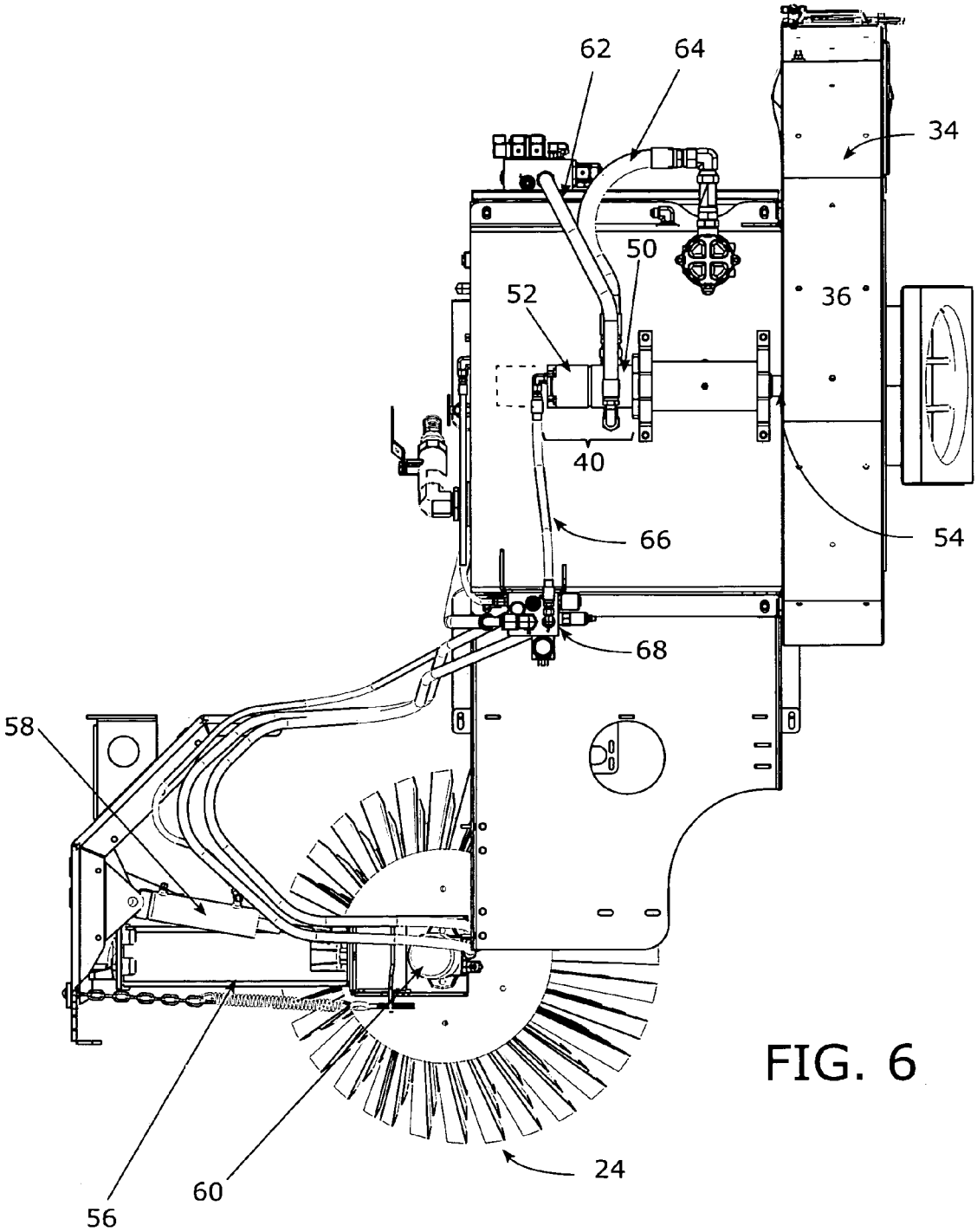
FIG. 6 is a top view of the forward part of the sweeper unit shown in FIG. 1 with selected components removed for reasons of clarity.
Figure 7:
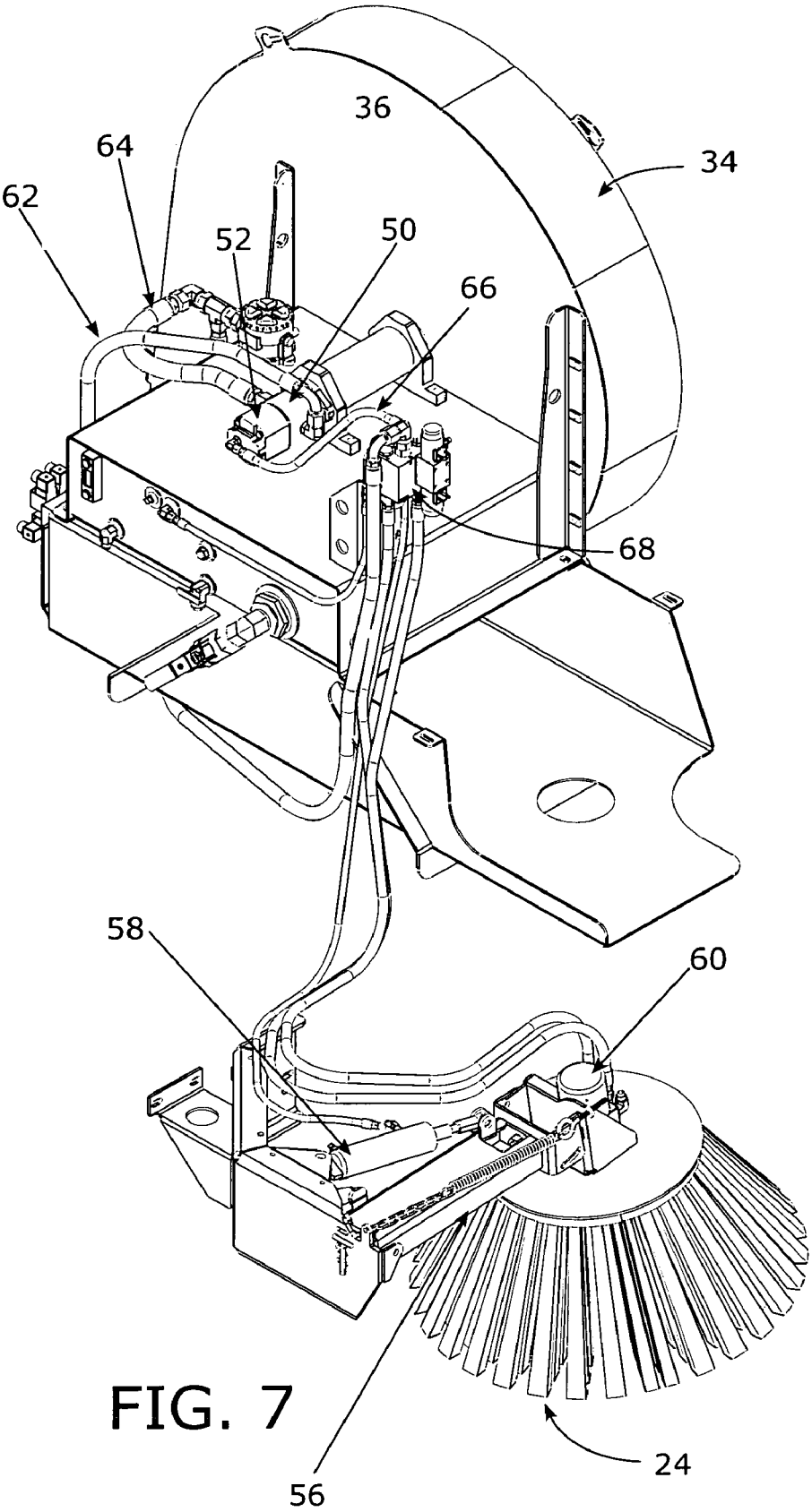
FIG. 7 is a perspective view of the forward part of the sweeper unit shown in FIG. 6.

FIG. 6 is a top view and FIG. 7 is a corresponding perspective view of the forward portion of the sweeper unit 14 with selected portions omitted for reasons of clarity to reveal the hydraulic components that drive the fan assembly 34 and the gutter broom 24.

As shown in FIGS. 6 and 7, the motor assembly 40 includes a primary fan drive motor 50 with a secondary displacement device 52 that is mounted to the back end of the primary drive motor 50 (i.e., a "piggybacked" mounting) so that the drive shaft of the secondary displacement device 52 is connected to or otherwise coupled to the shaft of the primary fan drive motor 50.

In one preferred embodiment, the secondary displacement device 52 can take the form of a motor 52-M (shown in FIG. 8) to provide a motor-motor configuration, and, in another equally preferred embodiment, the secondary displacement device 52 can take the form of a pump 52-P (shown in FIG. 9) to provide a motor-pump configuration.

In the embodiment where the secondary motor 52 is a conventional hydraulic drive motor, that motor also functions as flow divider, as explained below. As represented by the dotted-line unit to the left of the secondary motor/flow divider 52 in FIGS. 6 and 7, further displacement units may also be connected (i.e., further "piggybacked") to the primary fan drive motor 50 as the need arises. A drive shaft 54 extends from the forward end of the primary drive motor 50 and is connected to the fan wheel (not shown) within the fan housing 34.

The gutter broom 24 is mounted at the remote end of a pivoted beam assembly 56 that is raised or lowered by an appropriate hydraulic "lift" cylinder 58. A hydraulic motor 60 is mounted at the remote end of the beam assembly 56 and functions to rotate the gutter broom 24, as is conventional. A primary fluid supply line 62 that is connected to the hydraulic pump (not shown) connected to the truck engine provides a flow of hydraulic fluid to the primary drive motor 50 with return fluid provided through line 64. As explained more fully below in relationship to FIG. 8, a portion of the hydraulic fluid from the primary motor 50 can be passed through the secondary motor 52 through line 66 to the gutter broom supply-fluid manifold 68. The manifold 68 and related valving functions to supply fluid to the hydraulic "lift" cylinder 58 as well as the gutter broom motor 60.

During those periods of time during which gutter broom 24 is not in use, the fluid from supply line 62 is supplied to both the primary fan drive motor 50 and a secondary motor 52, which latter unit normally functions as a conventional torque-producing motor. Since the output shaft (not shown) of the secondary motor 52 is mechanically connected to the shaft of the primary fan drive motor 50, both units, 50 and 52, work together to provide torque to rotate the fan wheel.

During those periods of time during which the gutter broom 24 is in use, the fluid from supply line 62 is also supplied to both the primary fan drive motor 50 and the secondary motor 52. However and in response to appropriately controlled valving, discussed below in relationship to FIG. 8, the secondary motor 52 now functions as a flow-dividing device that routes a portion of the supply of hydraulic fluid to the gutter broom manifold for use by the gutter broom motor 60. The secondary motor 52 preferably has a thru-flow capacity sufficient to accommodate the cubic inch per revolution displacement of the gutter broom motor 60 (or motors) and any other hydraulic accessories, such as the lift cylinder 58, downstream of the secondary motor 52.

Figure 8:
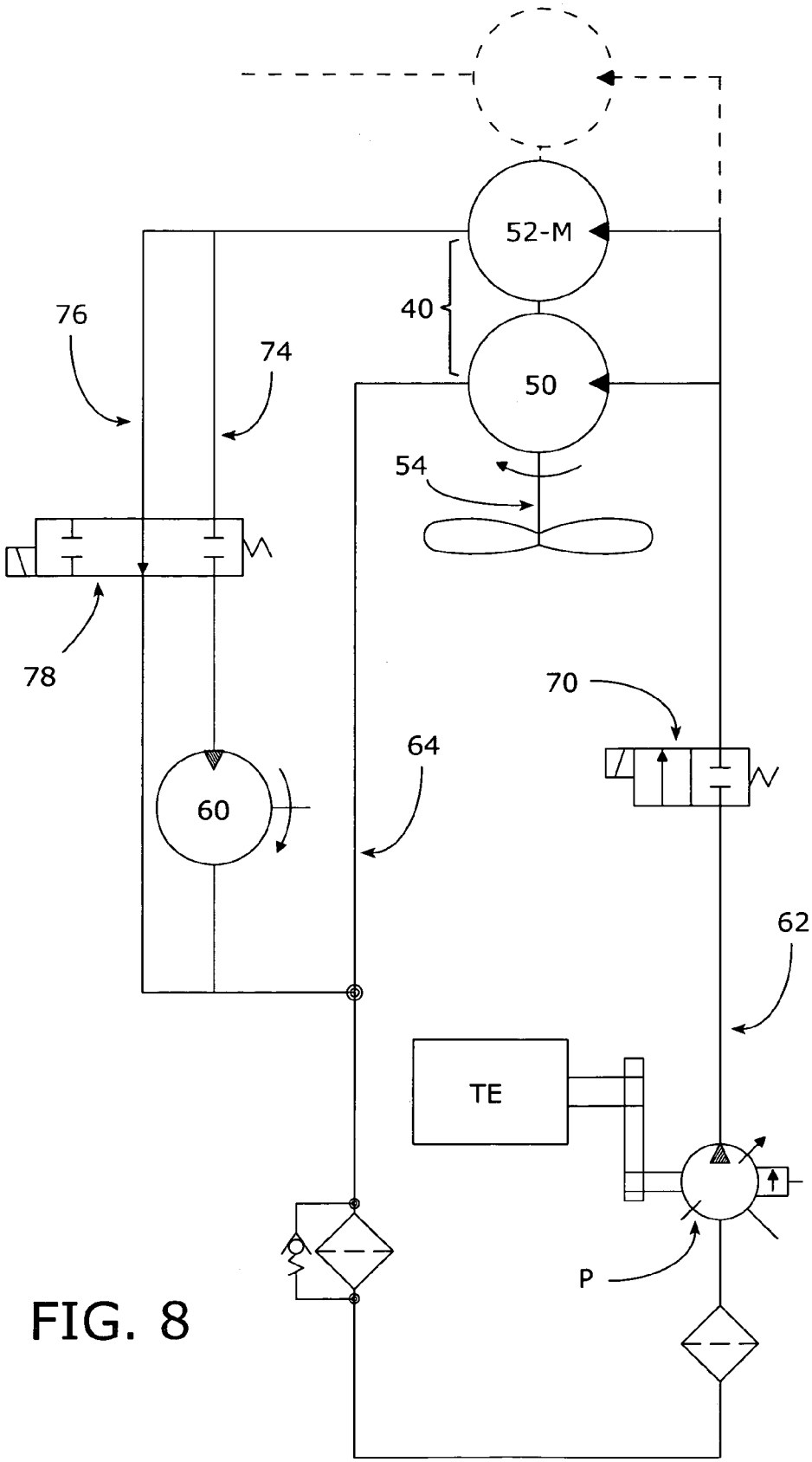
FIG. 8 is a first hydraulic circuit diagram illustrating a motor-motor (i.e., flow divider) arrangement.

A simplified and exemplary hydraulic circuit is shown in FIG. 8 for the motor-motor configuration described above; as shown, the truck engine TE drives a pump P through a belt and pulley arrangement (unnumbered) with a supply of fluid provided though line 62 to a flow/no-flow valve 70 to the motor assembly 40 which includes the primary fan drive motor 50 and the connected secondary motor 52-M. As represented by the dotted-line displacement unit above the secondary motor 52-M, more than one such secondary motor or displacement device can be connected to the primary fan drive motor 50. The drive shaft 54 of the primary fan drive motor 50 is shown connected to a schematically illustrated fan wheel (unnumbered). The return line 64 for the primary fan drive motor 50 connects to the input of the pump P. The return line of the secondary motor 52-M divides into two paths including a path 74 through the gutter broom motor 60 and a bypass path 76 with an appropriate control valve 78 located within paths 74 and 76. As shown in FIG. 8, the bypass pass 76 is operative while the path 74 is interrupted to prevent operation of the gutter broom motor 60. As can be appreciated the control valve 78 is operable to supply fluid to the gutter broom motor 60 while interrupting the bypass path.

In the motor-motor embodiment described above and a shown in FIG. 8, hydraulic fluid is supplied to both the primary fan drive motor 50 and its mechanically connected secondary motor 52 with both displacement units, 50 and 52-M, providing torque to the fan. During those periods of time during which the gutter broom(s) 24 is operating, appropriate valving directs a portion of the hydraulic fluid through the secondary motor 52-M, which now functions as a flow diverter, to the broom motor(s) 60 and any other auxiliary hydraulic components.

Figure 9:
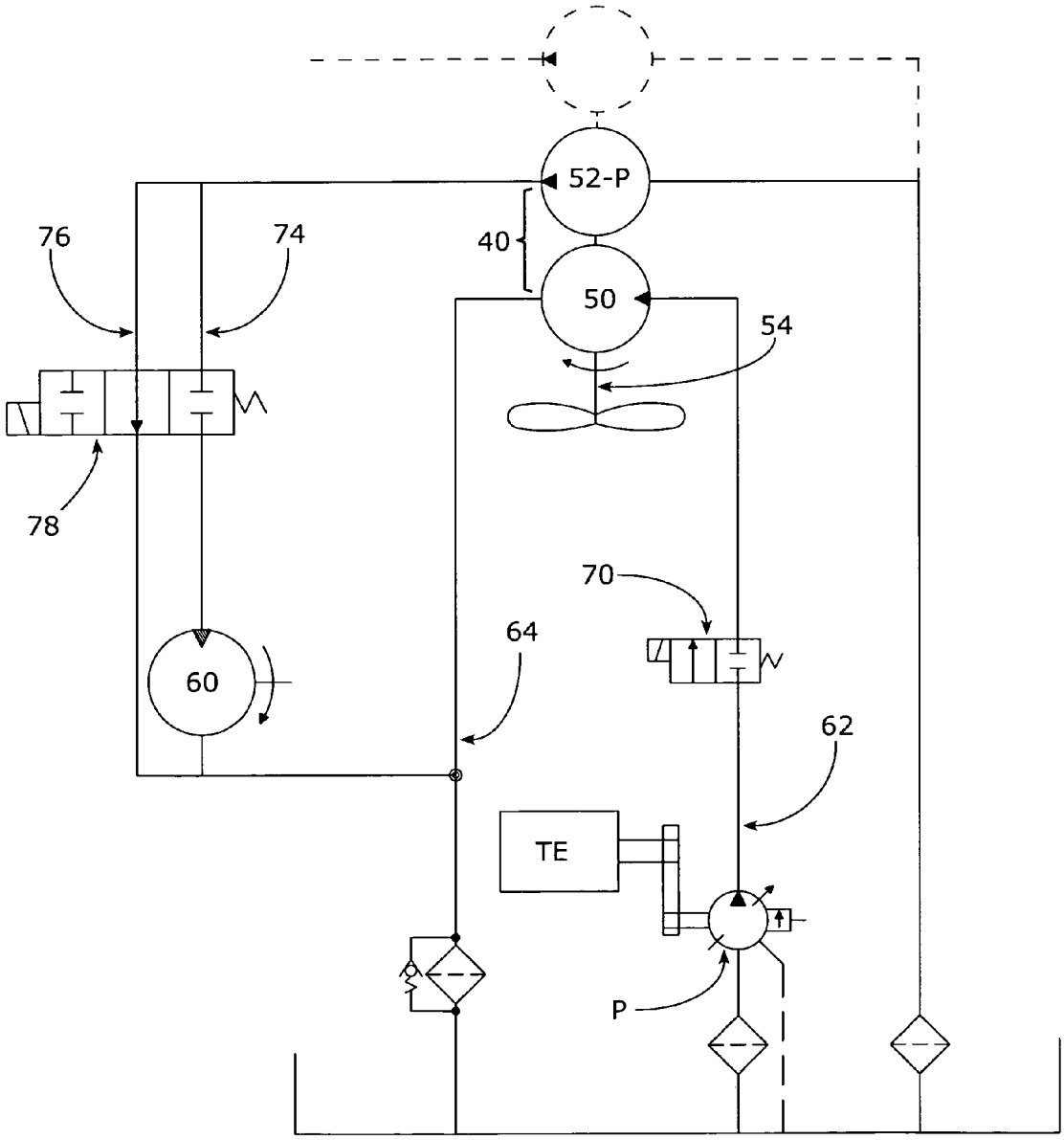
FIG. 9 is a second hydraulic circuit diagram illustrating a motor-pump arrangement.

FIG. 9 illustrates a hydraulic circuit for a motor-pump embodiment in which a pump 52-P is connected to the primary fan drive motor 52 and is plumbed so as to operate exclusively as a pump to provide a flow of hydraulic fluid to the curb broom manifold during those periods of time that the gutter broom(s) 24 is operating; the pump 52-P does not provide torque input to the fan when the curb broom is not in operation.

As can be appreciated, other variants are possible including a variant in which both a secondary motor 52-M and a pump 52-P are connect to the primary fan motor 50.

The motor-motor system disclosed allows full utilization of the secondary motor 52 as either a drive motor for the fan wheel or a flow diverting device for the gutter broom motor 60 (and/or related hydraulic equipment). In a similar manner, the motor-pump system disclosed allows utilization of the pump 52-P for the gutter broom motor 60 (and/or related hydraulic equipment). In contrast, the prior art systems utilize an auxiliary pump driven by a costly belt drive arrangement that suffers from inefficiency due to the losses associated with the belt drive; additionally, safety shrouds and related shielding adds to significantly to the construction/maintenance expense.

As will be apparent to those skilled in the art, various changes and modifications may be made to the illustrated embodiment of the present invention without departing from the spirit and scope of the invention as determined in the appended claims and their legal equivalent.

The invention claimed is:

1. A motorized pavement cleaning system for removing dust and/or debris from paved surfaces, comprising:

a wheeled vehicle having a cleaning unit mounted thereto;

means for providing a flow of hydraulic fluid;

said cleaning unit including a debris-containment hopper having an inlet for accepting a flow of debris-containing air, a pick-up head having an air-flow inlet and an air-flow outlet, said pick-up head for movement along the surface to be cleaned, a fan assembly for creating a flow of pressurized air at an outlet thereof, a torque-providing hydraulic displacement motor for driving said fan assembly to create a flow of pressurized air in response to a flow of hydraulic fluid therethrough, an air-flow connection between the outlet of the fan assembly and the inlet of the pick-up head, and another air-flow connection between the outlet of the pick-up head and the inlet of the hopper; and at least one other torque-providing displacement motor mechanically connected to said first-mentioned motor and through which a portion of the hydraulic flow is passed, said other torque-providing displacement motor operative in at least two modes including a first mode to contribute torque to drive the fan wheel or a second mode in which the first-mentioned torque-providing motor drives the fan wheel and the other torque-providing displacement motor controls the flow of hydraulic fluid to at least one auxiliary hydraulic device.

2. The motorized pavement cleaning system of claim 1, wherein said auxiliary hydraulic device comprises a hydraulic cylinder.

3. The motorized pavement cleaning system of claim 1, wherein said auxiliary hydraulic device comprises a hydraulic motor connected to a sweeping broom.

4. The motorized pavement cleaning system of claim 1, further comprising a flow/no-flow hydraulic valve in a flow circuit with said auxiliary hydraulic device to control the flow of hydraulic fluid thereto.

5. A motorized pavement cleaning system for cleaning paved surfaces of dust and/or debris, comprising:

a wheeled vehicle having a cleaning unit mounted thereto;

means for providing a flow of hydraulic fluid;

said cleaning unit including a debris-containment hopper having an inlet for accepting a flow of debris-containing air, a pick-up head having an air-flow inlet and an air-flow outlet, said pick-up head for movement along the surface to be swept, a fan assembly for creating a flow of pressurized air at an outlet thereof, a torque-providing hydraulic displacement motor for driving said fan assembly to create a flow of pressurized air in response to a flow of hydraulic fluid therethrough, an air-flow connection between the outlet of the fan assembly and the inlet of the pick-up head, and another air-flow connection between the outlet of the pick-up head and the inlet of the hopper; and a displacement pump mechanically connected to said motor and operative to selectively provide a flow of hydraulic fluid to at least one auxiliary hydraulic device.

6. The motorized pavement sweeper of claim 5, wherein said auxiliary hydraulic device comprises a hydraulic cylinder.

7. The motorized pavement sweeper of claim 5, wherein said auxiliary hydraulic device comprises a hydraulic motor connected to a sweeping broom.

8. The motorized pavement cleaning system of claim 5, further comprising a flow/no-flow hydraulic valve in a flow circuit with said auxiliary hydraulic device to control the flow of hydraulic fluid thereto.

* * * * *